United States Patent [19]

Abbey

[11] 4,118,444

[45] Oct. 3, 1978

[54] VARIABLE VENTURI CARBURETION SYSTEM

[76] Inventor: Harold G. Abbey, 11 Goldsmith Dr., Holmdel, N.J. 07733

[21] Appl. No.: 730,956

[22] Filed: Oct. 8, 1976

[51] Int. Cl.[2] ..... F02M 9/14

[52] U.S. Cl. ..... 261/44 A; 261/44 D; 261/50 A; 261/DIG. 56; 261/DIG. 63

[58] Field of Search ..... 261/DIG. 56, 44 R, 50 A, 261/44 A, 44 D

[56] References Cited

U.S. PATENT DOCUMENTS

| | | | |
|---|---|---|---|
| 1,133,904 | 3/1915 | Wyman | 261/DIG. 58 |
| 1,212,986 | 1/1917 | Moore | 261/DIG. 56 |
| 1,243,250 | 10/1917 | Brinkman | 261/44 R |
| 1,813,866 | 7/1931 | Royce | 261/44 R |
| 1,972,686 | 9/1934 | Lorenzen | 261/44 R |
| 1,979,918 | 11/1934 | Wahlmark | 261/44 R |
| 3,439,903 | 4/1969 | Tolnai | 261/44 R |
| 3,659,572 | 5/1972 | Pelizzoni | 261/44 R |
| 3,981,284 | 9/1976 | Gospodar | 261/50 A |
| 4,034,028 | 7/1977 | Ma | 261/DIG. 56 |

FOREIGN PATENT DOCUMENTS

| | | | |
|---|---|---|---|
| A20,989 | 5/1918 | France | 261/44 R |
| 197,825 | 5/1923 | United Kingdom | 261/44 R |

*Primary Examiner*—Tim R. Miles
*Attorney, Agent, or Firm*—Michael Ebert

[57] ABSTRACT

A carburetion system for supplying a fuel-air mixture to an internal combustion engine in a manner maintaining a desired ratio of fuel-to-air under varying conditions of operation to improve fuel economy and minimize the emission of pollutants. The system includes a carburetor having a tubular variable-Venturi structure whose effective cross-sectional areas are circular or annular, the converging inlet to the throat of the Venturi and the diverging outlet thereof having a configuration free of discontinuities regardless of the effective throat area. The Venturi areas and throat are varied by a control motor as a function of air flow that changes with engine demand. The fuel fed into the carburetor at the varying throat is metered by a valve whose effective orifice is varied by the motor concurrently with the change in Venturi throat area to maintain the desired ratio.

2 Claims, 11 Drawing Figures

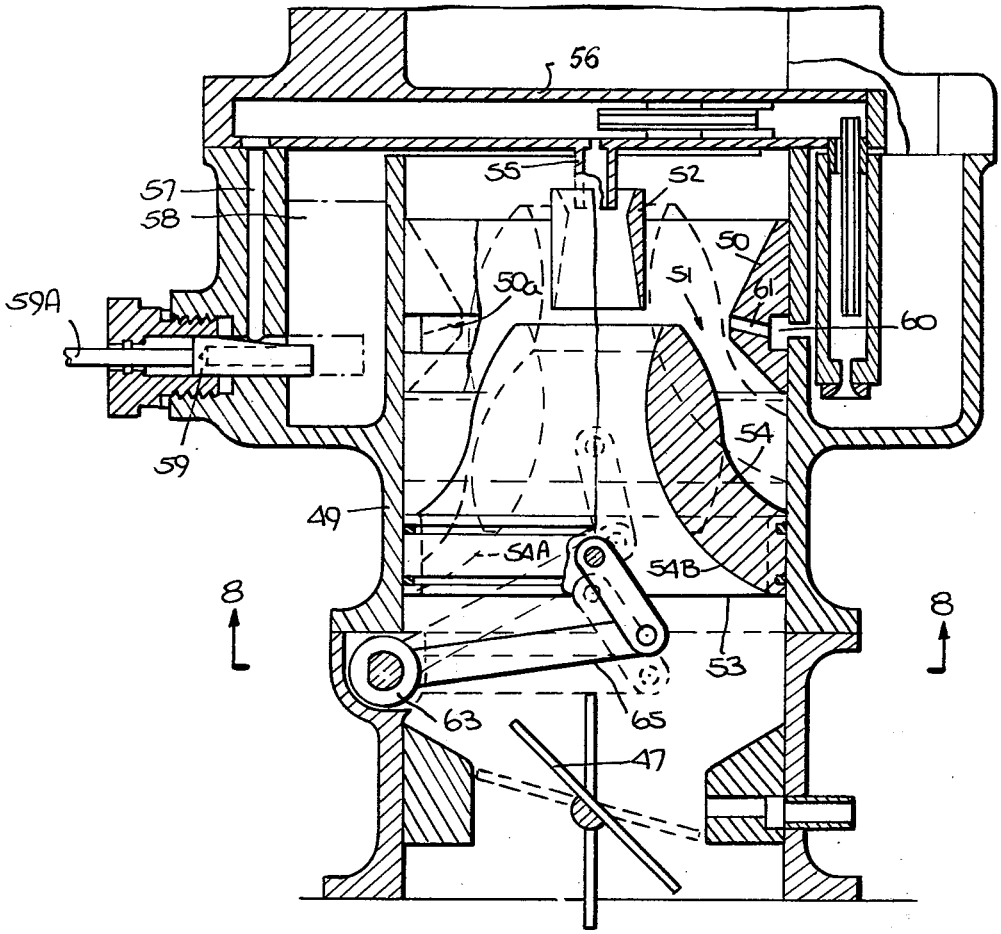
Fig. 7.
Fig. 6.
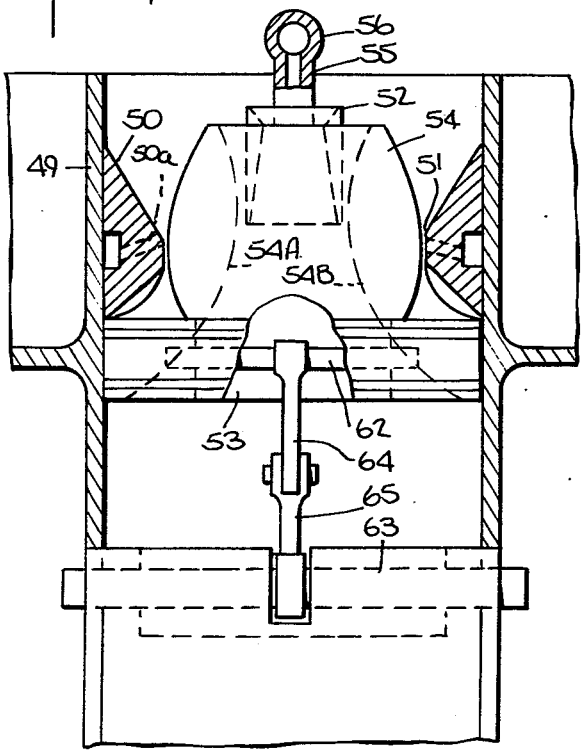
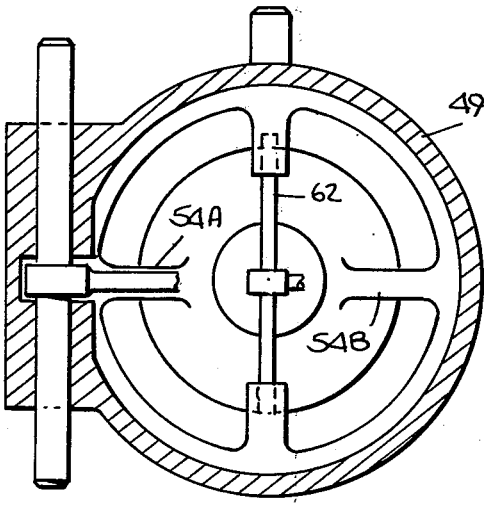
Fig. 8.

VARIABLE VENTURI CARBURETION SYSTEM

BACKGROUND OF INVENTION

This invention relates generally to carburetion systems for supplying a fuel-air mixture to an internal combustion engine, and more particularly to a system in which the effective parameters of a Venturi tube in a carburetor are controlled to optimize the shape and area ratios of the tube under varying conditions of operation.

The function of a carburetor is to produce the fuel-air mixture needed for the operation of an internal combustion engine. In the carburetor, the fuel is distributed in the form of tiny droplets in a stream of air, the droplets being vaporized as a result of heat absorption on the way to the combustion chamber whereby the mixture is rendered inflammable.

In a conventional carburetor, air flows into the carburetor through a Venturi tube which is generally circular in shape. The reduction in pressure at the Venturi throat causes fuel to flow from a float chamber in which the fuel is stored through a fuel jet into the air stream, the fuel being atomized because of the difference between air and fuel velocities.

The behavior of an internal combustion engine in terms of operating efficiency, fuel economy and the emission of pollutants is directly affected by the fuel-air ratio of the combustible charge. Under ideal circumstances, the engine should at all times burn 14.5 parts of air to one part of fuel to satisfy the stoichiometric air-to-fuel ratio. But in actual operation, this ratio varies as a function of operating speed and is affected by changes in load and temperature.

To obtain maximum economy, the fuel-to-air ratio in the mixture should be maintained within close tolerances in all modes of operation, such as "idle" while standing still, "slow-speeds" up to about 20 miles an hour, "cruising speeds" and "high speeds." The conventional practice is to provide an accelerating pump system to furnish an extra charge of fuel for quick bursts of speed, a choke system to enrich the mixture for starting a cold engine and a throttle by-pass jet for idle and slow speed.

Another reason why the maintenance of a steady fuel-to-air ratio is important is that the emission of pollutants is in large measure governed by this ratio. Thus, when the mixture is relatively low in air, carbon monoxide is produced, and when the ratio is excessively rich in fuel, unburned hydrocarbons are emitted in the exhaust.

A major problem encountered in carburetion is to secure the correct amount of suction around the needle valve at slow engine speeds and yet allow enough air to enter at high engine speeds to maintain the desired ratio of air and fuel. Venturi size must, of necessity, represent a compromise for both high and low speed operation. Because the maximum power an engine can develop is limited by the amount of air it can breathe in, the Venturi size should offer minimum resistance to the larger volume of air flowing at high engine speed. On the other hand, a small Venturi is desirable at low engine speeds to afford sufficient air velocity for controllable fuel metering and good fuel atomization.

The modern approach to this problem is the use of two or more Venturis arranged in series. The multiple Venturi design serves two purposes: First, the added Venturis build up air velocity in the smaller primary Venturi, thereby augmenting the force available at the main nozzle for drawing and atomizing fuel. Second, air by-passing the primary Venturi forms an air cushion around the rich mixture discharged by the Venturi, tending to improve mixture distribution by preventing fuel from engaging the carburetor walls. Idle or very slow speed is invariably served by an auxiliary jet around the edge of the throttle plate.

However, the typical modern carburetor requires a series of additional jets and pumping systems that cut in and out as the carburetor velocity increases and decreases above and below average speed, and as the engine operation passes through successive operating modes of acceleration, cruising, high speed and deceleration. Idle or very slow speed operations both rely on an idle jet arrangement at the closed position of the butterfly throttle valve. The actions of these auxiliary devices give rise to large fluctuations in the air-fuel ratio and thereby adversely affect fuel economy.

But fuel economy is not the only reason for maintaining a steady air-to-fuel ratio; for, as pointed out in *Business Week* (June 21, 1976), though a new catalytic converter is available which is adapted to limit the emission of hydrocarbons, carbon monoxide and nitrogen oxides, "A steady ratio (air-to-fuel) is crucial to the new converter because it must simultaneously harbor conflicting chemical reactions." As pointed out in this article, "in actual operation, the ratio fluctuates with acceleration and deceleration."

Although fuel-air mixtures may be introduced to the combustion chambers of an engine by means other than carburetors, as by fuel injection, supercharging and other expedients, none of these is comparable in effectiveness with the Venturi principle for efficient atomization of volatile fuels.

Attempts have heretofore been made to provide variable-Venturi carburetors to tailor the air-fuel supply to changing engine conditions. Thus U.S. Pat. Nos. 2,066,544; 3,659,572 and 3,778,041 show various embodiments of a variable-Venturi carburetor. But the arrangements disclosed in these patents are incapable of varying the effective parameters of a Venturi tube so as to maintain the optimum shape and area ratios of the tube throughout the operating range and to properly locate the fuel nozzles or jets in a continuously changing Venturi throat.

The throat of a Venturi, as this term is used herein, refers to that cross-section of the air-flow passage in the Venturi that is either the smallest or through which the air flow velocity is greatest, or conversely in which the static pressure is lowest.

SUMMARY OF INVENTION

In view of the foregoing, it is the main object of the invention to provide a variable-Venturi carburetion system in which the effective cross-sectional area of the Venturi tube remains circular or annular in shape as its throat is varied throughout the operating range of the engine to regulate the air-to-fuel ratio.

More particularly, an object of the invention is to provide a system of the above type in which a streamlined entry and discharge passage to and from the Venturi throat is maintained and in which the air flow parts of the variable elements are so shaped that the rate of change of the cross-sectional area of the throat is linear with respect to its movement.

Also an object of this invention is to provide a throttle valve and orifice plate assembly in a carburetor to produce a negative pressure or vacuum proportional to the air-fuel mixture flow into the engine for effecting Venturi control.

Briefly stated, in a system in accordance with the invention, a carburetor is provided having a variable Venturi structure, the effective area of whose throat is varied by a rotatable shaft as a function of air flow which changes with engine demand, the converging inlet to the throat and the diverging outlet thereof having a tubular configuration that is either circular or annular and is free of discontinuities regardless of the effective throat area. Fuel entry into the air flow passages in all variations of the throat from minimum to maximum is always at the throat.

The fuel fed into the carburetor is metered by a valve whose effective orifice is varied by the same shaft concurrently with the change in Venturi throat area to maintain a desired fuel-to-air ratio under varying conditions of operation, the shaft being driven by a motor whose direction and speed is varied in accordance with said air flow.

OUTLINE OF DRAWINGS

For a better understanding of the invention as well as other objects and further features thereof, reference is made to the following detailed description to be read in conjunction with the accompanying drawings, wherein:

FIG. 6 is a vertical section taken through a second embodiment of a carburetor system in accordance with the invention, in which the variable-Venturi is in one operating position;

FIG. 7 is a vertical section of the same system in which the variable-Venturi is in another operating position;

FIG. 8 is a transverse section taken in the plane indicated by lines 8—8 in FIG. 6;

DESCRIPTION OF THE INVENTION

First Embodiment

Figure 1:
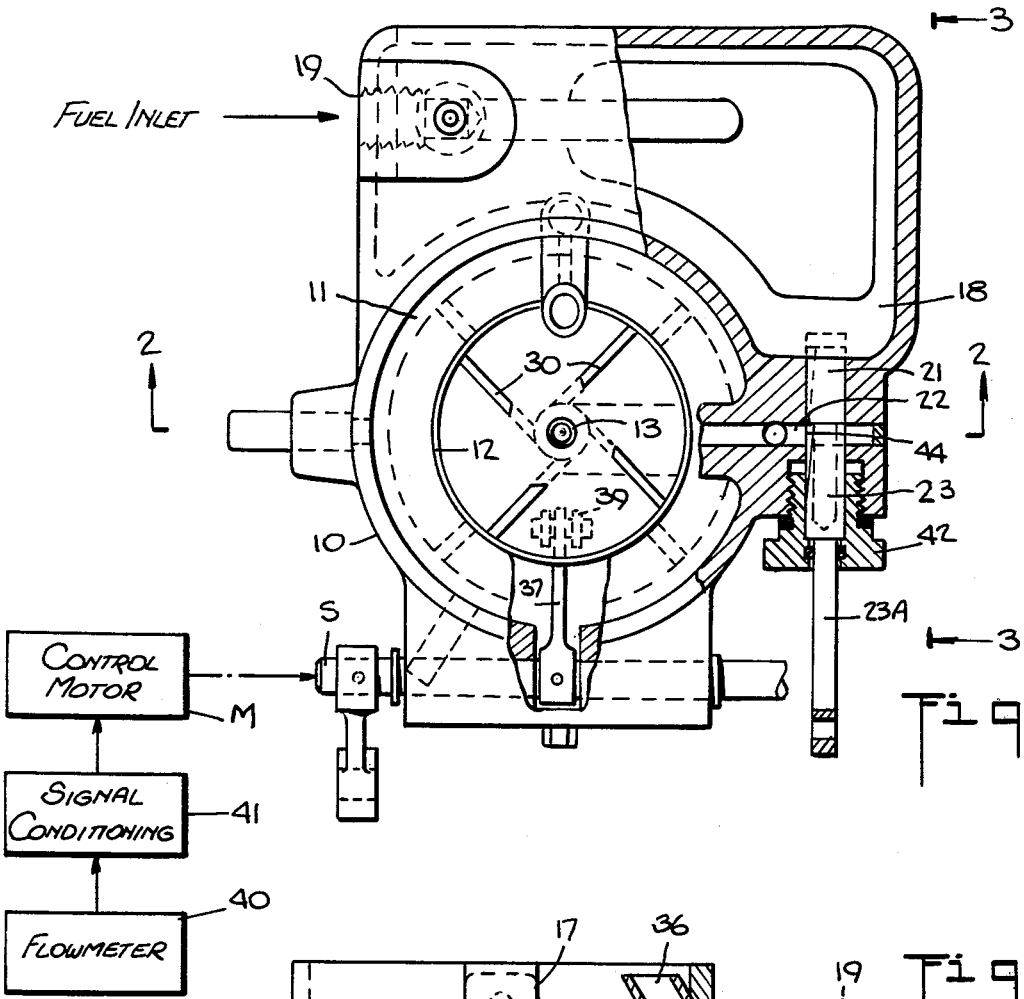
FIG. 1 is a top plan view of a first preferred embodiment of a variable-Venturi carburetor system in accordance with the invention.

Referring now to FIGS. 1 to 5, there is illustrated one preferred embodiment of a variable-Venturi carburetion system comprising a tubular casing 10 into which a downwardly flowing air stream is introduced at the upper end thereof. The lower section 10A of the casing is coupled to the intake manifold of an internal combustion engine to be supplied with a controlled air-fuel mixture.

Disposed within casing 10 is a variable-Venturi structure that includes a stationary ring 11 secured to the inner wall of the casing, the ring having a generally triangular cross-section with a flattened apex 11A. The ring cooperates with a plug 12 in the form of a truncated cone which is vertically movable with respect to ring 11 along a hollow guide post 13 to define an annular orifice or throat 14, the area of whose opening varies as a function of the axial position of plug 12 on post 13.

Post 13 is supported coaxially within casing 10 between an upper cantilever arm 15 and a lower cantilever arm 16, both arms projecting laterally from a vertical column 17. The diameter of the base of conical plug 12 is slightly smaller than the inner diameter of ring 11 as measured across apex 11A, whereas the diameter of the head of plug 12 is much smaller than the ID of the ring.

Arms 15 and 16 constitute the limits of plug movement. When plug 12 occupies its uppermost position, as indicated in dashed lines by plug 12′ in FIG. 2, the throat opening 14 between apex 11A and plug 12 is then highly constricted, whereas when plug 12 occupies its lowermost position, the throat opening is enlarged to its maximum value. Thus as the plug is moved from its lowermost to its uppermost position, the opening of annular throat 14 becomes progressively more constricted.

Figure 5:
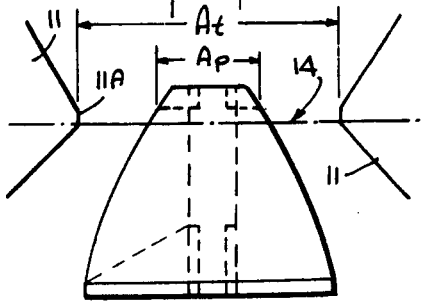
FIG. 5 is a separate view of the Venturi-structure in the first embodiment.

As separately illustrated in FIG. 5, the net effective areas $A_v$ of the annular throat 14 between apex 11A of the stationary ring 11 and the outer surface of the movable plug 12 is equal to the overall area $A_t$ of the throat in the absence of plug 12 (area $A_t$ is constant) minus the interposed area $A_p$ of plug 12 in the throat. This interposed area, which is the cross-sectional area of the plug in the plane of the throat, varies with the axial position of the plug; hence $A_v = A_t - A_p$.

In the lowermost plug position shown in FIG. 5, area $A_v$ attains its maximum value in the operating range of the Venturi structure, and, as plug 12 is caused to move upwardly by means of a control motor to be later described, the interposed area $A_p$ then proceeds to increase in value, as a consequence of which the net effective throat area $A_v$ decreases until a minimum value is attained. This minimum value is determined by the constricted clearance space between the base of conical plug 12 and apex 11A.

The tapering profile of conical plug 12 is such as to produce, in the downward direction of the air stream, in annular converging path toward throat 14, from which point the path then diverges into the Venturi mixing chamber VM. Thus the pressure drop at the constricted throat causes an increase in the velocity of the fluid passing therethrough. These paths are free of discontinuities regardless of the plug position and afford a streamline entry to and exit from the throat to minimize frictional losses. The surface profile of plug 12 is preferably such as to provide a linear relationship between plug displacement $A_p$ and net effective throat area $A_v$. However, in some instances the profile may be curved to provide an exponential or other relationship between these variables.

As best seen in FIG. 1, fuel is admitted to a carburetor reservoir 18 through an inlet 19, the reservoir having a float 20 therein (see FIG. 3) to maintain the fuel level at a desired value. Fuel from reservoir 18 is admitted into a passage 21 which leads to a duct 22 formed in the lower plug-supporting arm 16 by way of a fuel metering valve 23.

Figure 2:
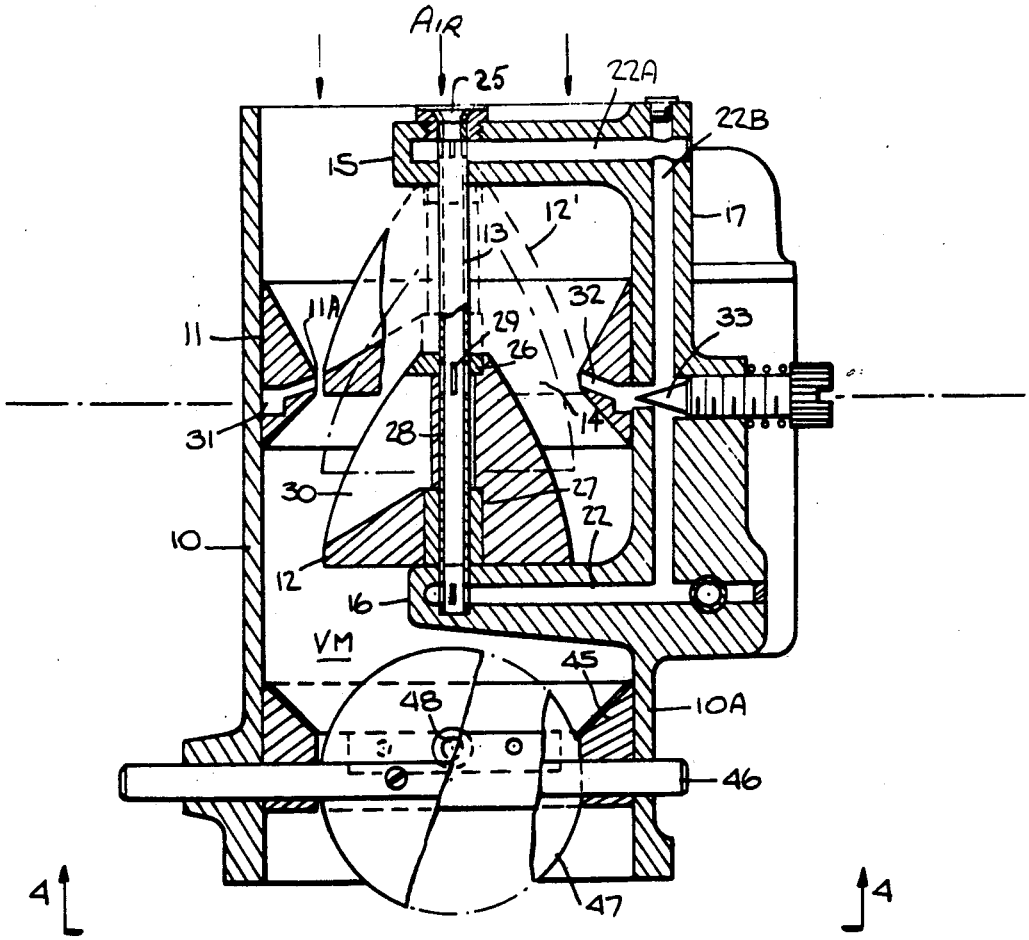
FIG. 2 is a vertical section taken in the plane indicated by line 2—2 in FIG. 1.
Figure 4:
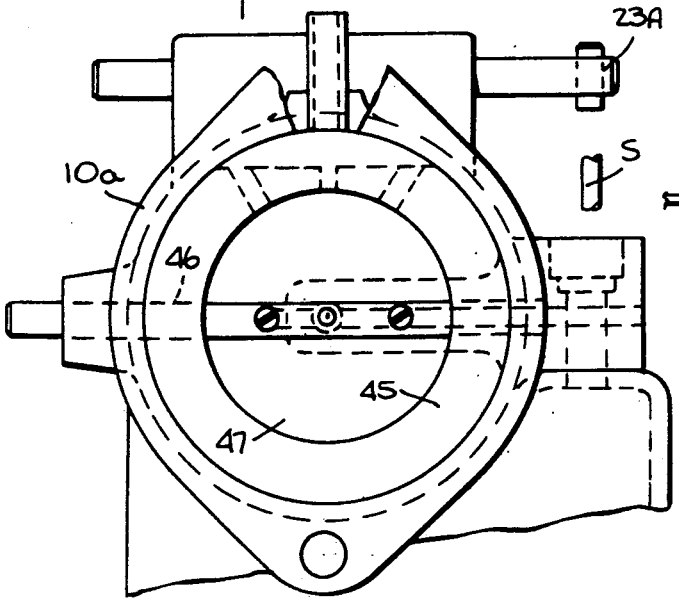
FIG. 4 is a bottom view taken in the direction indicated by arrows 4—4 in FIG. 2.

Duct 22, as shown in FIG. 2, communicates with the lower end of an internal passage in guide post 13, the upper end of this passage being coupled to a duct 22A in the interior of upper arm 15. Ducts 22 and 22A are interconnected by a duct 22B formed in the vertical column 17 to complete an endless loop. The upper end of guide post 13 is secured to upper arm 15 by means of an air-compensating coupler 24 having an air port 25 therein.

Post 13 extends through a central bore in plug 12, which is provided at its head with a slidable seal 26 that engages post 13 and at its base with a slidable seal 27. A plenum 28 is defined between the inner bore wall of plug 12 and the outer surface of post 13 in the space between the head and base seals 26 and 27. Fuel is admitted into this plenum through jet opening 29 in post 13, the openings being in alignment with throat 14 of the Venturi structure.

This fuel is sprayed into throat 14 through equispaced longitudinal slots 30 formed in plug 12, the slots extending from the inner wall to the outer surface of the plug, this being the main fuel supply for the Venturi structure.

An auxiliary fuel supply for the Venturi structure is created by means of a circular channel 31 formed in stationary ring 11 adjacent casing 10 at a position below apex 11A, channel 31 communicating with throat 14 through inclined jet opening 32 which extends between the channel and the higher apex. Channel 31 is coupled to fuel duct 22B in column 17 through an adjustable valve 33 whose setting determined the amount of auxiliary fuel admitted into the channel.

Metering valve 23 controls the overall amount of fuel admitted into the fuel loop defined by post 13 and ducts 22, 22A and 22B, whereas adjustable valve 23 determines the ratio between the amount of fuel emitted through the main jets 29 and the amount emitted through the auxiliary jets 32. It will be seen that regardless of the position of plug 12, the main and auxiliary fuel jets always project fuel toward the throat of the Venturi and that the displacement of the plug does not disturb this vital relationship. The auxiliary fuel jets in the stationary ring of the Venturi provide a fuel supply in the idle mode and at any increase in speed as determined by the setting of control valve 33.

Figure 3:
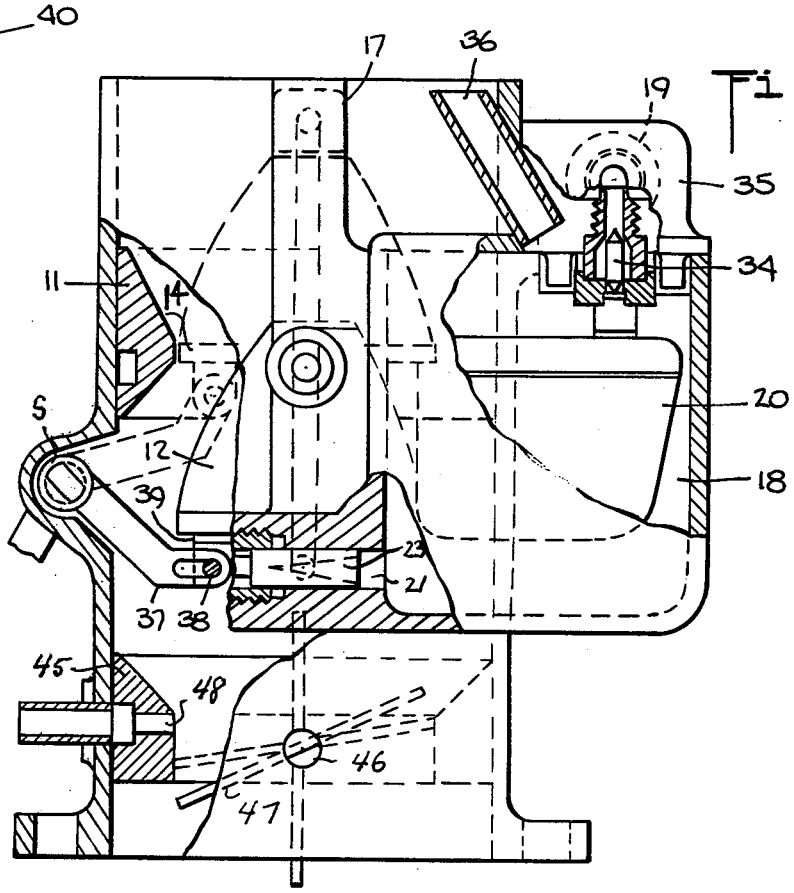
FIG. 3 is a side view of the carburetor structure as seen in the direction indicated by arrows 3—3 in FIG. 1.

In order to maintain the fuel supply at a level just below jet openings 29 and 32, float 20 in reservoir 18, as shown in FIG. 3, actuates an inlet valve 34 in the fuel intake 19, valve 34 being mounted in the reservoir cover 35. A vent tube 36 leads to the upper space of fuel reservoir 18 to provide air flow compensation.

Displacement of plug 12 is effected by a lever 37 (see FIGS. 1 and 3), one end of which is slotted to receive a pin 38 in a clevis 39 attached to the plug, the other end of the lever being keyed to a rotatable shaft S driven in either direction by a control motor M. Shaft S which functions to displace Venturi plug 12 is also operatively linked to metering valve 23 through a slidable actuating rod 23A, so that the axial displacement of rod 23A acts to linearly vary the fuel orifice between fuel passage 21 leading from fuel reservoir 18 into duct 22 of the fuel loop.

Thus as shaft S turns in a given direction to displace plug 12 in the Venturi structure to adjust the effective area of throat orifice 14, it concurrently adjusts the effective orifice of the fuel metering valve 23 to maintain a desired ratio of air-to-fuel in the mixture thereof generated in the carburetor throughout the capacity range of the unit.

The adjustment of the variable Venturi-fuel metering valve combination must be controlled in accordance with the air flow so that a constant velocity and hence a constant negative pressure is developed in the Venturi throat throughout the range of engine demands. This may be effected by a vortex-type or any other suitable flowmeter 40 responsive to the air flow to produce a signal proportional thereto which is processed in an electronic signal conditioning circuit 41 for operating control motor M. A vortex meter yields an analog signal proportional to flow rate, and this may be converted into a digital signal for processing by an integrated circuit minicomputer adapted to control motor M as a function of flow rate.

Inasmuch as the operative position of the variable-Venturi structure is made proportional to air flow, the larger the opening of the Venturi throat 14 to maintain the velocity at an increased air flow rate, the greater the amount of fuel that must be drawn into the air stream to maintain a constant air-fuel ratio. A variable orifice type valve in the fuel supply can best provide the proportional increase or decrease in the fuel induced into the air stream.

Metering valve 23 satisfies this requirement, for, as shown in FIG. 1, actuating rod 23A extends through a sealing gland 42 attached to the tubular valve body 43 which is slidably fitted in a cylindrical hole located in the carburetor casing at a position at which it communicates with fuel reservoir 18 at the inlet end and terminates in the gland nut 42. The outlet is fuel passage 22 which is cross drilled into the valve hole.

Tubular body 43 is taper-slotted at 44 so that the position of the valve body determines at which position the taper slot 44 is open to the outlet hole in passage 22. Thus the changing size of the opening between the fuel supply and the fuel passage leading to the Venturi acts as a variable flow control valve by varying the working opening.

As shown in FIG. 2, lower section 10A of the carburetor casing is provided with an orifice plate 45 having a rounded or tapered entry to avoid flow discontinuities. Mounted for rotation on an axis rod 46 within the orifice of plate 45 is a butterfly throttle valve plate 47. Orifice plate 45 is provided with openings 48 on the side opposite axis rod 42 that is always between throttle valve plate 47 and Venturi mixing chamber VM thereabove.

The location of openings 48 in the throat of orifice plate 45 with throttle valve plate 47 separating it from the manifold in all positions, provides a negative pressure or vacuum to both the pressure across the throttle valve and the added factor of pressure across the orifice openings, thereby yielding a greater and more linear pressure differential with flow than the pressure drop across the throttle plate alone. Use of a rounded inlet to the orifice plate minimizes losses through the throttle valve, thereby increasing the volumetric efficiency of the engine and promoting faster vaporization of the fuel.

The combinations of a conventional butterfly throttle valve in an orifice plate as described herein provides a negative pressure or vacuum that is hereinafter designated "flow-vacuum."

Second Embodiment

Referring now to FIGS. 6, 7 and 8, there is shown a second embodiment of a carburetor system in accordance with the invention wherein disposed within tubular casing 49 is a Venturi structure including a stationary Venturi ring 50 having a generally triangular cross-section and a flattened apex 50A to define a Venturi throat 51 that surrounds the outlet of a Venturi booster 52 mounted coaxially within the casing at the upper end thereof.

The Venturi structure is completed by a ring 53 which slides along the wall of casing 49 and supports a hollow bowl-shaped plug 54 which is secured to ring 53 by diametrically-opposed struts 54A and 54B. The ring-plug assembly 53–54 is movable from a position in which the head of plug 54 lies within throat 51 below the outlet of booster 52, as shown in FIG. 6, to a position in which plug 54 is concentric with booster 52, as shown in FIG. 7.

A fuel nozzle 55 disposed centrally at the inlet of booster 52 is coupled via a fuel pipe 56 and a duct 57 to fuel reservoir 58 through a fuel metering valve 59. Fuel pipe 56 also supplies fuel to a circular channel 60 feeding fuel to auxiliary jets 61 which communicate with apex 50A of the fixed ring 50 to eject auxiliary fuel into throat 51.

Plug 54 is axially shifted from a position, as shown in FIG. 6, where it lies below the outlet of booster 52 to a position concentric therewith, as shown in FIG. 7, by means of a pin 62 connected athwart the slidable ring 53. The pin is operatively coupled to an actuating shaft 63 by a link 64 and a lever 65.

The movement of ring plug assembly 53–54 from its lowermost to its uppermost position steplessly reduces the net by-pass area of throat 51 by gradually increasing the cross-sectional area interposed by the bowl-spaced plug. This effective area varies the main Venturi flow through fuel nozzle 55 from maximum by-pass (FIG. 6) to minimum by-pass (FIG. 7).

Shaft 63 is operatively coupled to the actuating rod 59A of metering valve 59 and is controlled by a motor M as in the first embodiment in accordance with flow rate in the manner previously described.

Third Embodiment

Figure 9:
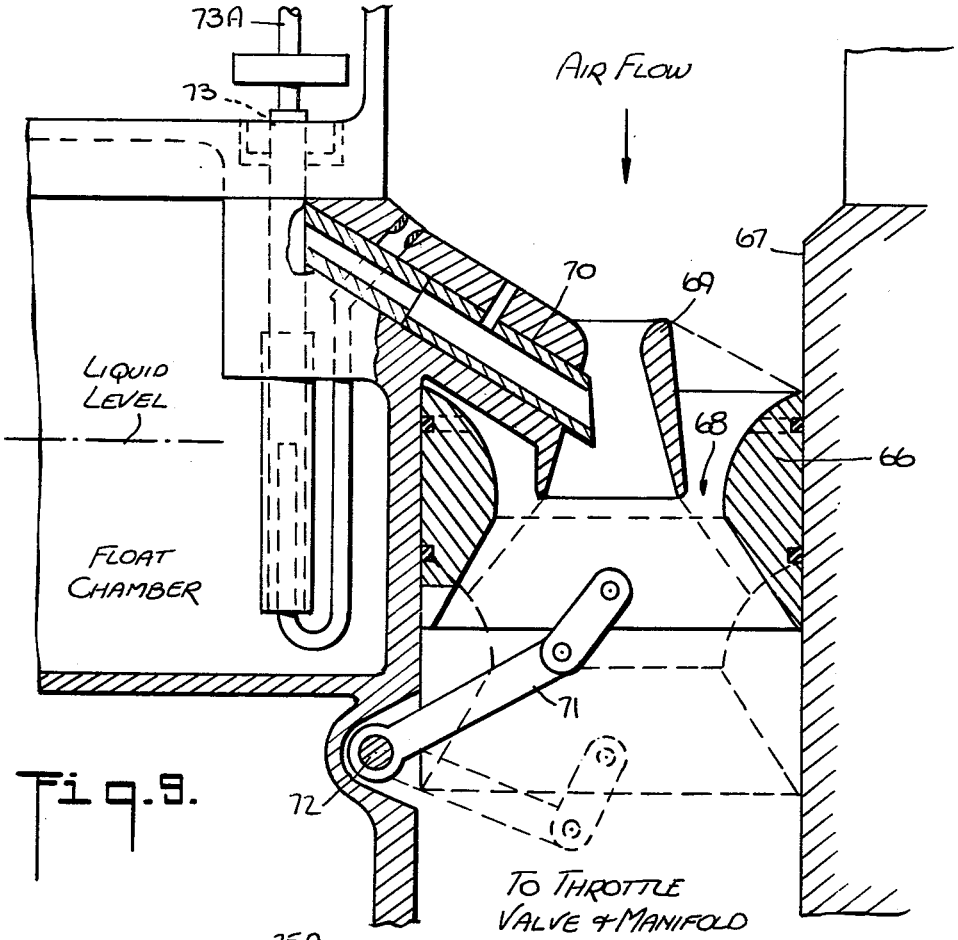
FIG. 9 is a vertical section taken through a third embodiment of a system in accordance with the invention.

As shown in FIG. 9, the third embodiment of the invention is a single-booster type of carburetor provided with a Venturi ring 66 slidable along the wall of a casing 67 to define a throat 68 with respect to the fixed booster 69. Fuel is fed into the booster through an inclined nozzle 70 provided with air bleeds.

Ring 66 is shifted axially by a linkage 71 coupled to an actuating shaft 72 driven by motor M as in the first embodiment. This shaft is also operatively coupled to the actuating rod 73A of fuel metering valve 73 which linearly varies the flow of fuel into nozzle 70.

The position of the profiled ring 66 relative to the outlet of booster 69 determines the by-pass throat area to provide a stepless increase of the net effective throat area acting on the fuel nozzle. "Flow-vacuum" actuated means are provided to position the variable-Venturi with changing engine demand while concurrently proportioning the fuel to maintain a constant air-to-fuel ratio.

Fourth Embodiment

Figure 10:
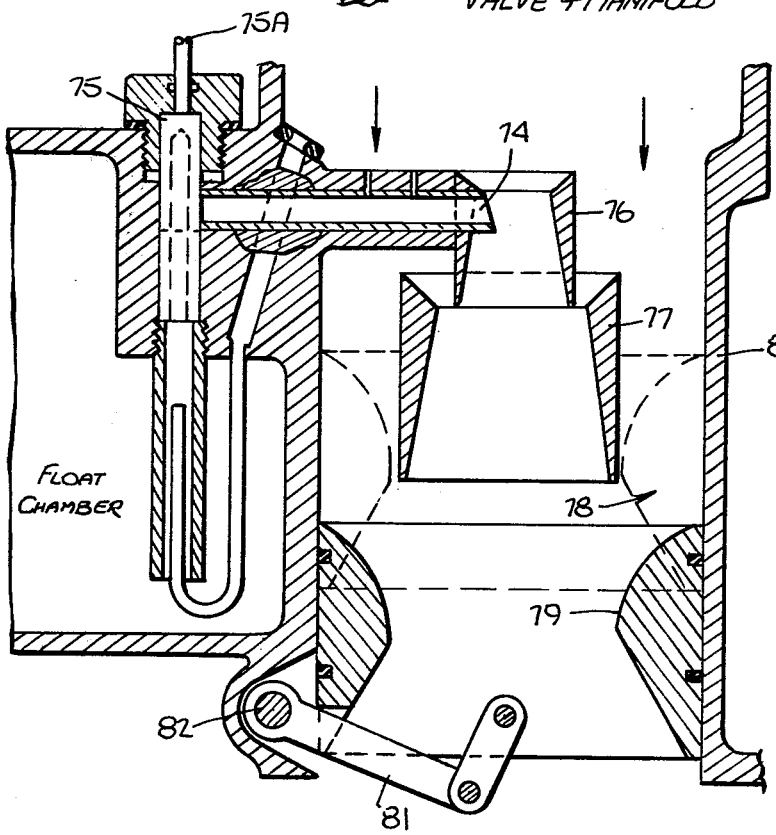
FIG. 10 is a vertical section taken through a fourth embodiment of the invention.

As shown in FIG. 10, the fourth embodiment of the invention has a primary booster 76 supplied with fuel by a nozzle 74 which communicates with the fuel reservoir through a metering valve 75. Primary booster 76 cooperates with a secondary booster 77 which defines a by-pass throat 78 whose net effective area is determined by a displaceable Venturi ring 79 slidable within casing 80.

Ring 79 is moved by a linkage 81 coupled to an actuating shaft 82 which is also operatively linked to the actuating rod 75A of metering valve 75 so that motor M serves to concurrently vary the effective Venturi throat area and the amount of fuel introduced into the Venturi to maintain the desired fuel-to-air ratio under all operating conditions.

Automatic Carburetor Control System

Figure 11:
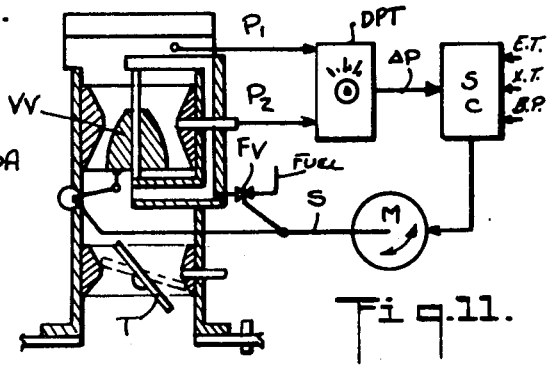
FIG. 11 schematically illustrates a carburetor control system in accordance with the invention.

As shown schematically in FIG. 11, an automatic control system is provided for a variable-Venturi carburetor of the type shown in the first embodiment of the invention and provided with a variable-Venturi plug VV. It will be appreciated that the same system is also applicable to the other embodiments of the carburetor.

In this system, use is made of an electronic controller or microprocessor SC to which an adjustable set point is applied by means of a differential-pressure transducer DPT. Applied to transducer DPT is the variable $P_1$ representing the air pressure into the Venturi of the carburetor as well as a second variable $P_2$ representing the static pressure at the throat of the Venturi.

The differential pressure value yielded by transducer DPT which is converted into a corresponding electrical value $\Delta P$ for application to the microprocessor. Value $\Delta P$ is proportional to $P_1 - P_2$ and varies as a function of air velocity. This velocity depends on the position of throttle T and engine demand. In practice, transducer DPT may take the form of a differential-transformer operating in conjunction with a diaphragm subjected to pressures $P_1$ and $P_2$.

Also applied to electronic controller SC is a variable value ET that is a function of engine temperature, a variable value XT that depends on exhaust temperature, and a variable value BP depending on barometric pressure.

Microprocessor SC is responsive to the relationship of adjustable set point $\Delta P$ with respect to variable values ET, XT and BP to produce a control signal CS for controlling the direction and degree of motion of a bi-directional motor M. Motor M functions to vary the position of the Venturi plug VV and to concurrently vary the size of the orifice of the fuel valve FV in the manner disclosed in connection with FIG. 1. This motor, in the case of an electronic system, takes the form of a reversible d-c motor. The control system may, however, take the form of an equivalent pneumatic arrangement, in which event a vacuum motor is used.

In operation, adjustable set point $\Delta P$ is set at a desired air flow velocity in the throat of the Venturi. A change in the position of throttle T, made by the operator's foot control while the engine is running, causes set point $\Delta P$ to increase or decrease. Control motor M or an equivalent actuator in response to the resultant control signal CS then acts to move plug VV to restore $\Delta P$ to the set point.

An increase in $\Delta P$ results in an increase in the Venturi throat area, whereas a decrease in $\Delta P$ produces a decrease in the area to restore the velocity. An increase or decrease in the Venturi size enlarges or contracts the orifice of fuel valve FV to proportion the air-fuel ratio accordingly.

When the engine is off or cold, plug VV closes to the choke position. When the engine stalls and is warm, plug VV closes to a low-speed run position. In acceleration, a delay in response which is actuated by a wide-open throttle (or kick down) will enrich the air-fuel ratio until a null is reached, thereby obviating the need for jet pumps.

The microprocessor functions to modify the set point of the transducer DPT for choking (cold start), for a cold engine, for a cold exhaust temperature, and for changes in barometric pressure or air temperature. It also serves for temperature delay of the opening, for choke and cold running control. For this purpose, the response time of the microprocessor is provided with a suitable time delay.

Summary

In a system in accordance with the invention, a constant velocity of air flow is held throughout the range of engine demand, this velocity being maintained at the throat of the Venturi structure. The fuel input at or in communication with the throat of the Venturi is maintained for optimum atomizing efficiency. A streamlined annular inlet and outlet for the Venturi is maintained for optimum flow efficiency with minimal losses. The metering of fuel into the carburetor is varied linearly with a linear change of air flow to maintain a constant air-to-fuel ratio throughout the operating range.

In all embodiments of the invention, an optimum shape is maintained in all variations of the effective size of the Venturi from minimum to maximum, and the fuel entry is at the point of minimum pressure or conversely at the point of maximum velocity. In the Venturi, the converging inlet to the throat and the diverging outlet therefrom is always circular or annular throughout its operating range to avoid any step action or discontinuity in the flow passage.

While there have been shown and described preferred embodiments in accordance with the invention, it will be appreciated that many changes and modifications may be made therein without, however, departing from the essential spirit thereof.

I claim:

1. A carburetion system for supplying a fuel-air mixture to an internal combustion engine in a manner maintaining a desired ratio of fuel-to-air under varying conditions of engine demand to improve fuel economy and minimize the emission of pollutants, said system comprising:

A. a carburetor having a variable-Venturi structure mounted within a tubular casing and having a converging inlet to a throat and a diverging outlet therefrom, all having a circular cross-sectional area, control means to mechanically adjust the effective area of the throat of the Venturi without introducing discontinuities in the converging inlet to the throat and in the diverging outlet therefrom which leads into a mixing chamber, a fuel feed means including a metering device concurrently operated by said control means to introduce fuel into the throat of said structure to be intermixed in said chamber with air passing through said Venturi structure to produce said fuel-air mixture; said variable-Venturi structure including a fixed ring mounted on said casing and having a triangular cross-section with a flattened apex, a plug axially movable within said casing relative to said ring, said plug having a truncated conical shape whose base has a diameter slightly smaller than the diameter of said ring measured across said apex to provide a constricted throat when said base in in line with said apex, said plug having a head whose diameter is small with respect to said apex diameter to provide an enlarged throat when said head is in line with said apex, a guide post coaxially mounted in said casing and cantilevered upper and lower arms extending from a vertical column to support said post, said post passing through a central bore in said plug whereby said plug is slidable on said post between the limits of said arms, said post and said arms being hollow to provide ducts for supplying fuel thereto, said post having jet openings in line with said apex to eject fuel into said throat through slots in said plug;

B. means sensing the rate of air flowing through said Venturi structure as a function of engine demand to produce a control signal dependent thereon;

C. a motor operating said control means; and

D. means responsive to said control signal to govern said motor to adjust said control means in a direction and to an extent maintaining the desired fuel-to-air ratio under varying conditions of engine demand.

2. A system as set forth in claim 1, further including jet openings in said ring communicating with the duct in said column to eject auxiliary fuel into said throat.

* * * * *